US010918234B1

(12) United States Patent
Lawver

(10) Patent No.: US 10,918,234 B1
(45) **Date of Patent: *Feb. 16, 2021**

(54) DRESSING AID

(71) Applicant: Lindsey Janae Lawver, Joplin, MO (US)

(72) Inventor: Lindsey Janae Lawver, Joplin, MO (US)

( * ) Notice: Subject to any disclaimer, the term of this patent is extended or adjusted under 35 U.S.C. 154(b) by 70 days.

This patent is subject to a terminal disclaimer.

(21) Appl. No.: 16/418,484

(22) Filed: May 21, 2019

Related U.S. Application Data

(63) Continuation-in-part of application No. 16/132,613, filed on Sep. 17, 2018, now Pat. No. 10,292,517.

(51) Int. Cl.
*A47G 25/90* (2006.01)

(52) U.S. Cl.
CPC ..... *A47G 25/907* (2013.01); *A47G 2200/04* (2013.01); *A47G 2400/10* (2013.01)

(58) Field of Classification Search
CPC ..... A47G 25/907; A47G 25/90; A47G 25/901–908; A47G 2200/04; A47G 2200/046; A47G 2400/10
USPC ..... D2/642
See application file for complete search history.

(56) References Cited

U.S. PATENT DOCUMENTS 129,175 A * 7/1872 Russell ..... A47G 25/90 223/111
1,954,792 A * 4/1934 Arnold ..... A41F 3/00 2/325
1,972,533 A * 9/1934 Mix ..... A41F 3/00 2/330
2,047,810 A * 7/1936 Wagner ..... A41F 3/02 24/600.9
2,514,756 A * 7/1950 Garren ..... A41F 3/00 2/340
2,521,326 A * 9/1950 Bayon ..... A41F 3/00 2/326
2,727,247 A * 12/1955 Bailey ..... A41F 17/00 2/323
4,947,870 A * 8/1990 Larcher ..... A61F 5/37 128/869
5,129,105 A * 7/1992 Kleinman ..... A41D 31/085 2/328

(Continued)

OTHER PUBLICATIONS

"Sammons Preston Flexibel Teaspoon with Foam Handle, Bendable Spoon with Extended Handle and Strap for Evaluating Self Feeding Needs, Customizable Cutlery for Disabled, Handicapped, Elderly" www.amazon.com/Sammons-Preston-Evaluating-Customizable-Handicapped/dp/B071KZQGTL, 6 pp, Jun. 2019.

*Primary Examiner* — Ismael Izaguirre
(74) *Attorney, Agent, or Firm* — Shane Cortesi

(57) ABSTRACT

A dressing aid may include a main arm having a proximal end and a distal end, at least one (preferably at least two) proximal arm extending from the main arm proximal end, the proximal arm(s) having a distal end attached to the main arm proximal end and a proximal end attached to a proximal clip, and at least one (preferably at least two) distal arm extending from the main arm distal end, the distal arm(s) having a proximal end attached to the main arm distal end and a distal end attached to a distal clip. The proximal and distal arms may further comprise a hook. The proximal, distal and main arms are preferably formed of a bendable but rigid tubular material.

28 Claims, 12 Drawing Sheets

(56) References Cited

U.S. PATENT DOCUMENTS

| | | | | |
|---|---|---|---|---|
| 7,921,474 | B2 * | 4/2011 | Miller | A41F 9/025 2/338 |
| 9,861,767 | B2 * | 1/2018 | Okihara | A61M 5/5086 |
| 2005/0205619 | A1 * | 9/2005 | Morel | A47G 25/90 223/111 |
| 2015/0083761 | A1 * | 3/2015 | Clifton | A47G 25/905 223/118 |
| 2016/0022078 | A1 * | 1/2016 | Sclafani | A41F 11/16 2/315 |

* cited by examiner

DRESSING AID

RELATED APPLICATIONS

This application is a continuation-in-part of U.S. patent application Ser. No. 16/132,613, filed Sep. 17, 2018, the entire contents of which are incorporated herein by reference.

BACKGROUND

Technical Field

The present invention relates to dressing aids.

Background of the Invention

Elderly and other users with limited mobility have difficulty putting on pants and other clothing items.

A number of devices have been developed to assist the users.

For example, dressing sticks are used for assisting users in taking off socks. In addition, reachers, sock aids, and claws are used to help users pull on socks, shoes and pants.

U.S. Pat. No. 5,884,371 (the '371 Patent) teaches a dressing aid in the form of a band with two chip clips at the ends. The band is preferably in the form of a cord, which may be comprised of any conventional material that is durable and flexible such as cloth, leather, plastic and elastic materials. Preferably, the band is 70% nylon and 30% polypropylene. The Sammons Pant Clip (Sammons Preston), available on Amazon, is similar to the device disclosed in the '371 Patent.

However, the lack of rigidity in the device could be problematic for users with limited mobility.

Therefore, there is a need for new dressing aids that are easy to use for users with limited mobility.

BRIEF SUMMARY

The present disclosure provides dressing aids as described herein. In some embodiments, the present disclosure provides a dressing aid comprising: a main arm having a proximal end and a distal end; at least two proximal arms extending from the main arm proximal end, each of the at least two proximal arms having a distal end attached to the main arm proximal end and a proximal end attached to a proximal clip; and at least two distal arms extending from the main arm distal end, each of the at least two distal arms having a proximal end attached to the main arm distal end and a distal end attached to a distal clip. Optionally, the main arm, the at least two proximal arms and the at least two distal arms are bendable, rigid and not elastic. Optionally, the at least two proximal arms and the at least two distal arms are metallic. Optionally, the at least two proximal arms and the at least two distal arms are formed of gooseneck tubing or another type of flexible but rigid and not elastic type of tubular material. Optionally, each proximal arm and each distal arm comprises a hook. Optionally, each hook of the proximal arm comprises a lower end attached to the proximal arm and a free upper end and further wherein each hook of the distal arm comprises a lower end attached to the distal arm and a free upper end. Optionally, the hooks are L-shaped. Optionally, each hook is comprised of an elastic material. Optionally, each proximal arm comprises a proximal arm interior surface facing the other respective proximal arm and a proximal arm exterior surface opposite the interior surface, wherein each distal arm comprises a distal arm interior surface facing the other respective distal arm and a distal arm exterior surface opposite the interior surface and further wherein the hooks of the proximal arms are attached to the exterior surface of the proximal arms and the hooks of the distal arms are attached to the exterior surface of the distal arms. Optionally, the main arm is in the shape of a bent cylinder. Optionally, the proximal arms and the distal arms are in the shape of a bent cylinder, the main arm comprises a diameter, and the proximal arms and distal arms have a smaller diameter as compared to the main arm diameter. Optionally, the clips are alligator clips. Optionally, the proximal arms and the distal arms are approximately the same length and shorter than the main arm.

In still further embodiments, the present disclosure provides a method of donning a garment providing the steps of: a) providing the dressing aid; b) providing a garment; c) attaching the clips to the garment; and d) grasping the main arm and moving the garment over a user. Optionally, each proximal arm and each distal arm is bent in multiple directions. Optionally, the main arm is U-shaped. Optionally, the garment is a leg garment. Optionally, at least one of the proximal arms and at least one of the distal arms comprises a hook and the method further comprises draping the garment over the clip.

In still further embodiments, the present disclosure provides a dressing aid that may include a main arm having a proximal end and a distal end, at least two proximal arms extending from the main arm proximal end, each of the at least two proximal arms having a distal end attached to the main arm proximal end and a proximal end attached to a proximal clip; and at least two distal arms extending from the main arm distal end, each of the at least two distal arms having a proximal end attached to the main arm distal end and a distal end attached to a distal clip. Optionally, the main arm, the at least two proximal arms and the at least two distal arms are bendable, rigid and not elastic. Optionally, the at least two proximal arms and the at least two distal arms are comprised of at least one tube having a hollow interior comprising a bendable metallic rod. Optionally, the at least one tube is plastic. Optionally, the dressing aid further comprises a foam covering surrounding at least a portion of the main arm. Optionally, the foam covering does not cover the at least two proximal arms and the at least two distal arms. Optionally, the foam covering is comprised of a closed cell foam. Optionally, the foam covering and the main arm are generally U-shaped. Optionally, the at least one tube is comprised of two tubes that are joined to form the main arm, the two tubes extending away from each other at the proximal and distal ends of the main arm to form the two proximal and two distal arms. Optionally, the at least two proximal arms and the at least two distal arms are comprised of segmented ball and socket tubing having a hollow interior. Optionally, the dressing aid further comprises a foam covering surrounding at least a portion of the main arm. Optionally, the foam covering does not cover the at least two proximal arms and the at least two distal arms. Optionally, the foam covering is comprised of a closed cell foam. Optionally, the foam covering and the main arm are generally U-shaped. Optionally, at least one proximal arm and at least one distal arm comprises a hook as previously described. Optionally, the main arm is in the shape of a bent cylinder, the proximal arms and the distal arms are in the shape of bent cylinders, wherein the main arm comprises an outer diameter, and further wherein the proximal arms and distal arms each have a smaller outer diameter as compared to the main arm outer diameter. Optionally, the proximal arms and the distal arms are approximately the same length and shorter than the main arm. The present disclosure also provides a method of donning a garment that may include a) providing the dressing aid; b) providing a garment; c) attaching the clips to the garment; and d) grasping the main arm and moving the garment over a user. Optionally, the garment is a lower extremity garment and step d) comprises grasping the main arm, positioning the garment at a base of a foot of a user and moving the garment over the foot of the user.

BRIEF DESCRIPTION OF THE DRAWINGS

in FIG. 7, the main arm and proximal and distal arms are formed of gooseneck tubing.

DETAILED DESCRIPTION

Figure 1:
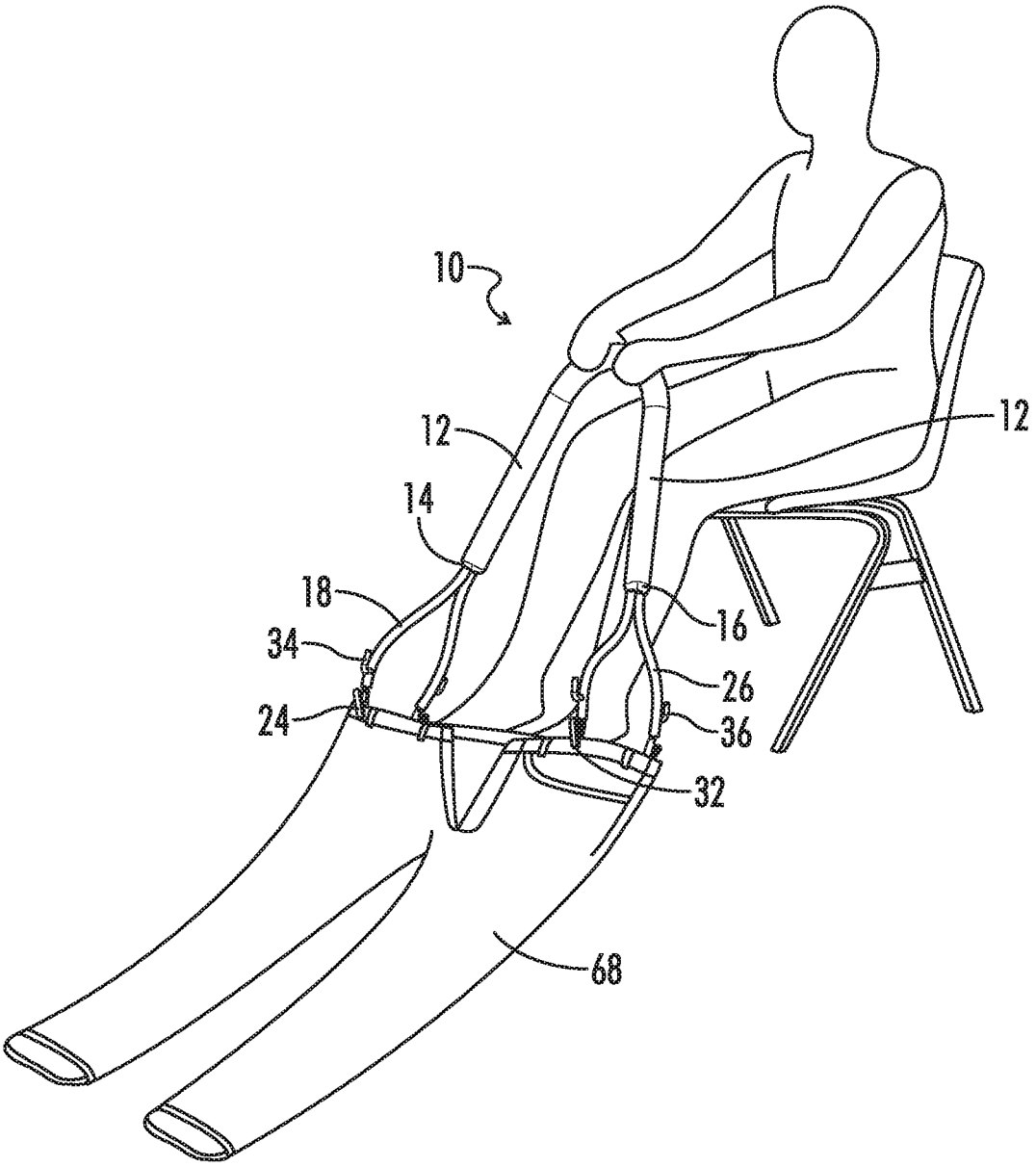
FIG. 1 illustrates a front perspective view of a person using a dressing aid of one embodiment of the present invention.
Figure 2:
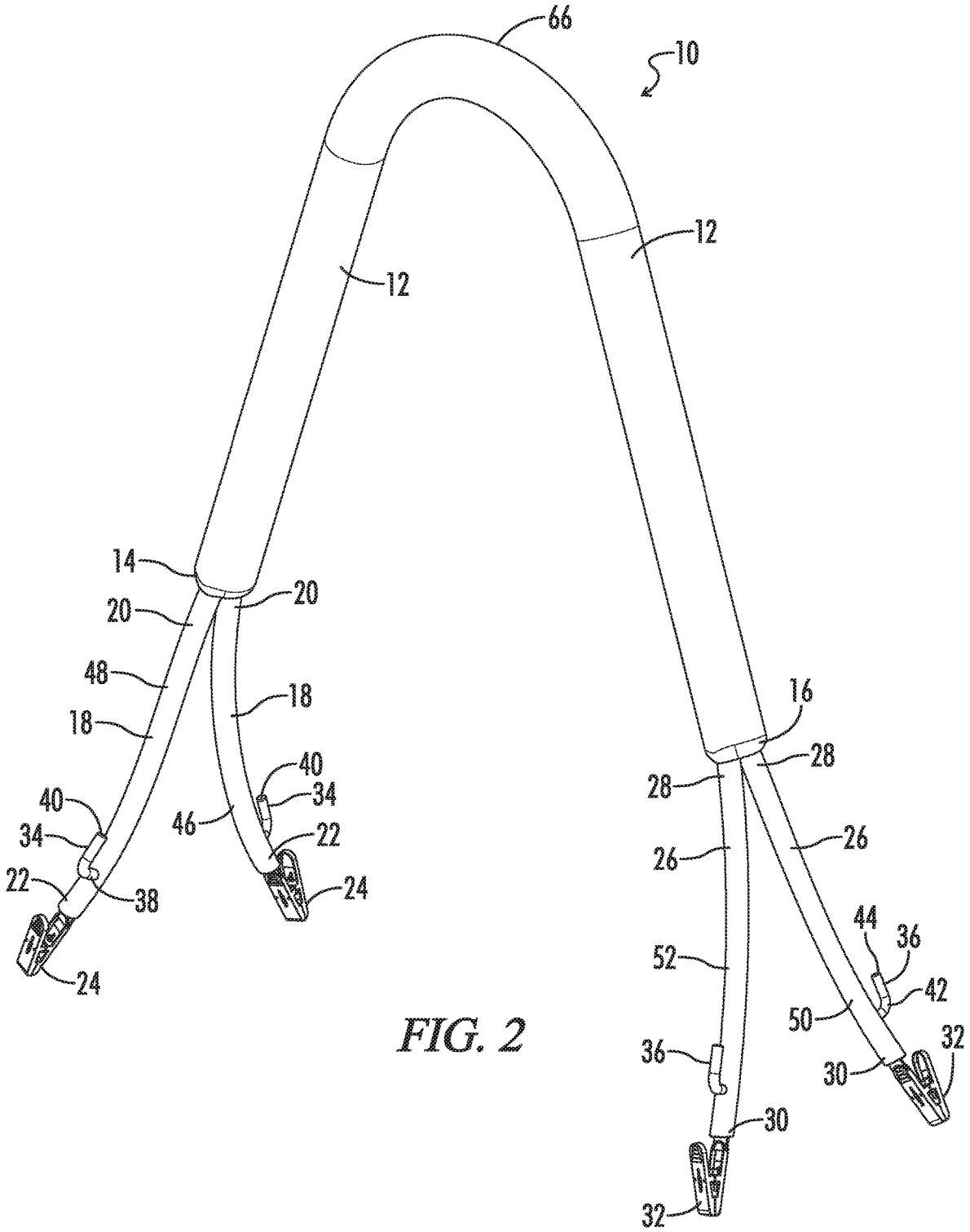
FIG. 2 illustrates a front perspective view of the dressing aid of FIG. 1 with the proximal and distal arms in another orientation.
Figure 3:
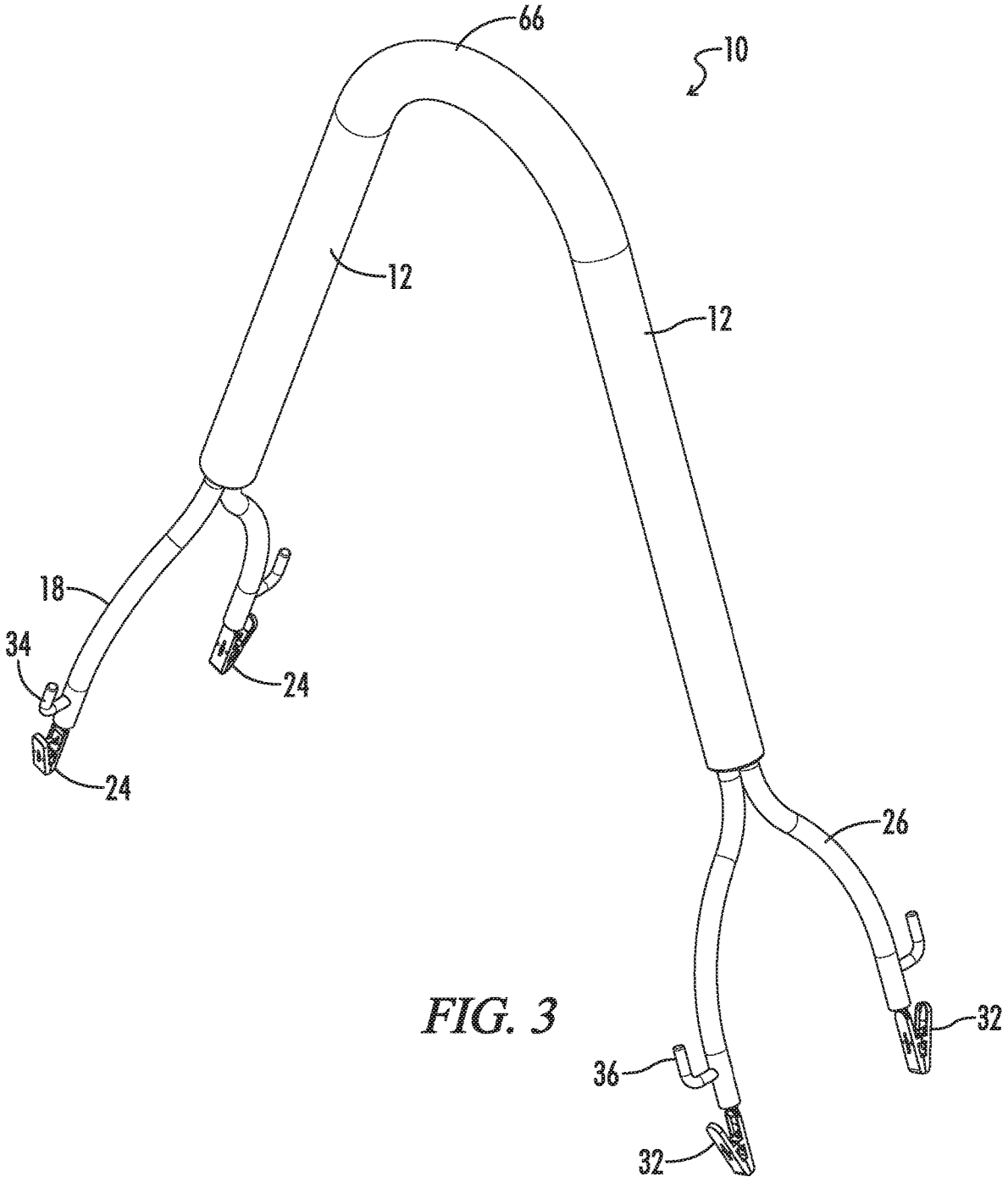
FIG. 3 illustrates a front perspective view of the dressing aid of FIG. 2 with the proximal and distal arms in another orientation.
Figure 4:
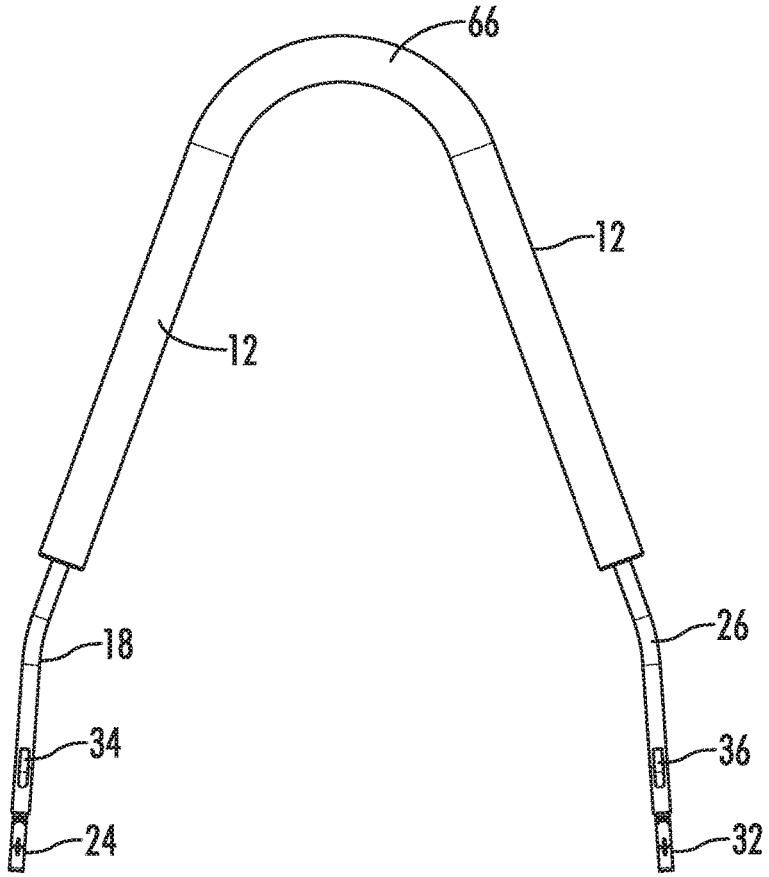
FIG. 4 illustrates a front elevation view of the dressing aid of FIG. 3.
Figure 5:
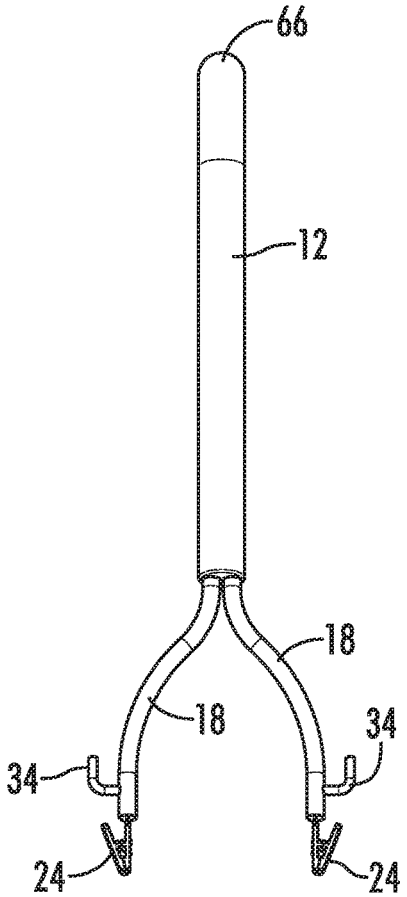
FIG. 5 illustrates a side elevation view of the dressing aid of FIG. 4.
Figure 6:
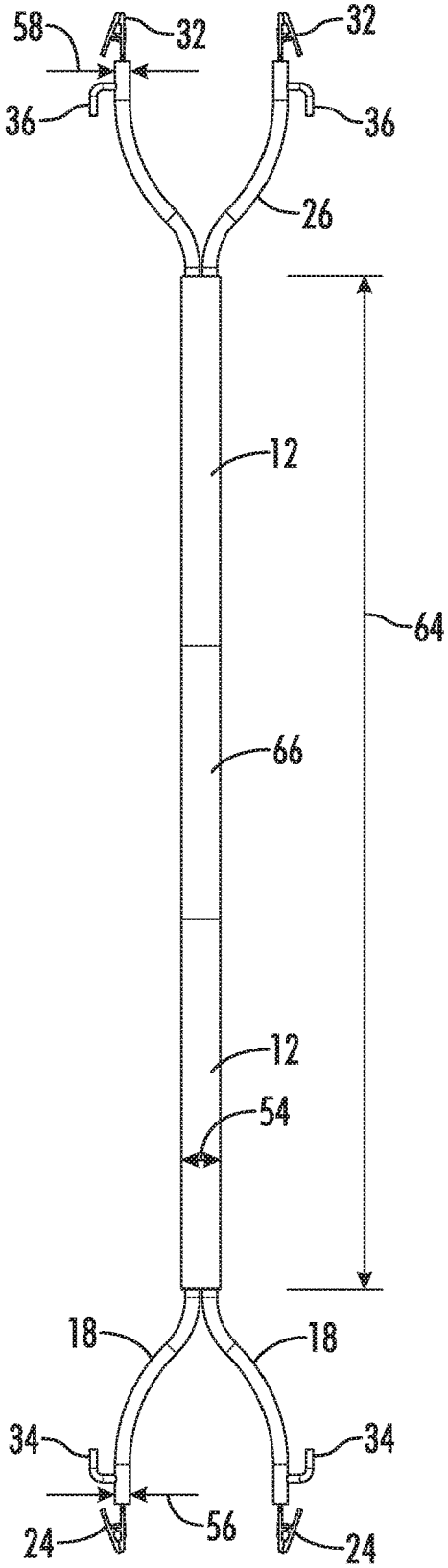
FIG. 6 illustrates a top plan view of the dressing aid of FIG. 5 with the main arm in another orientation.
Figure 7:
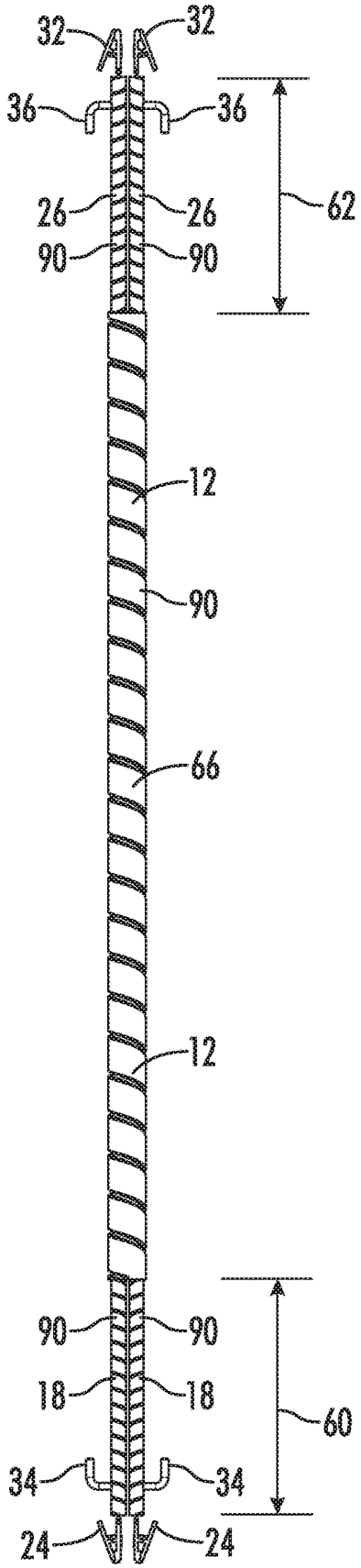
FIG. 7 illustrates a top plan view of the dressing aid of FIG. 6 with the proximal and distal arms in another orientation.
Figure 8:
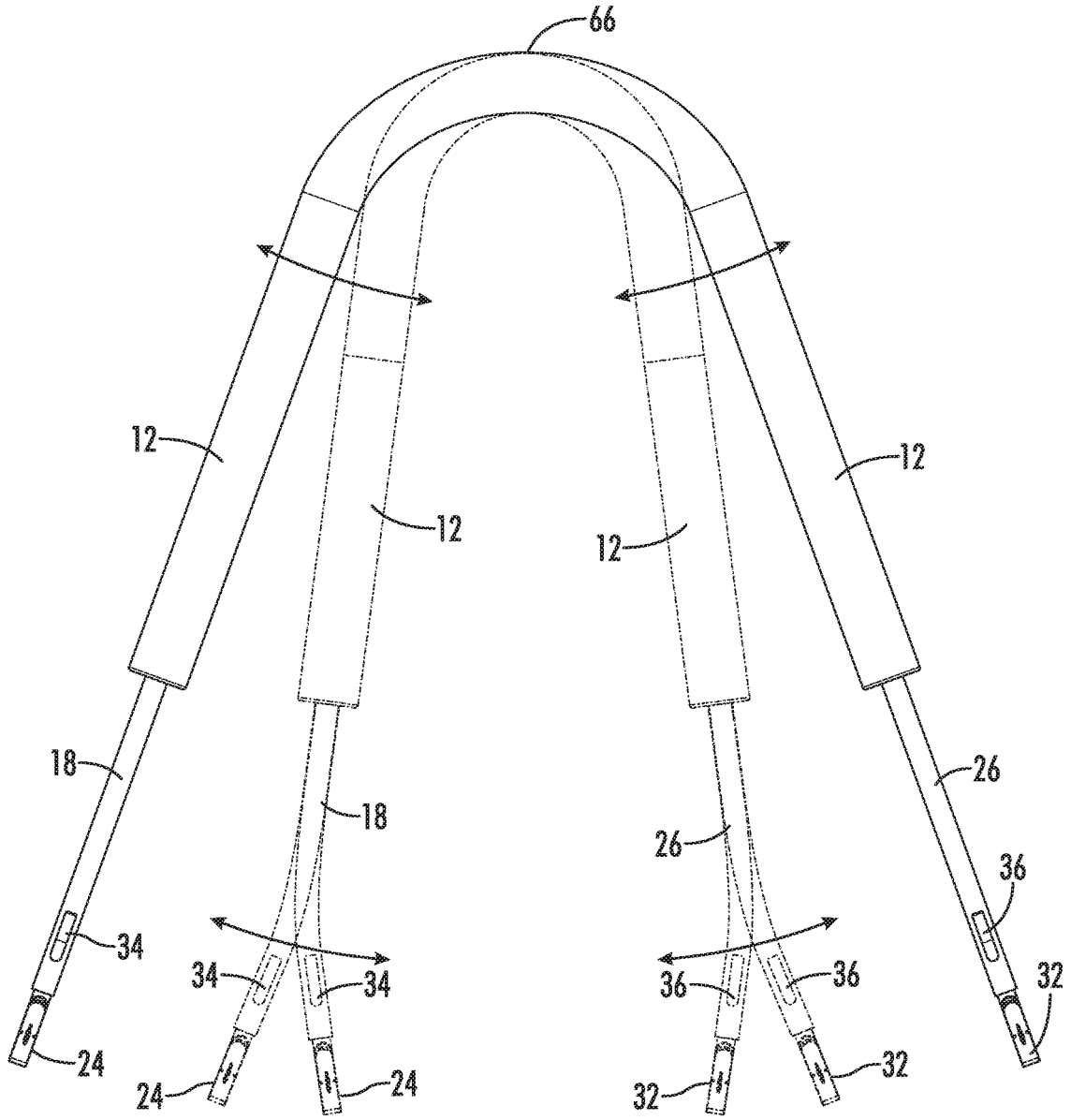
FIG. 8 illustrates a front elevation view of the dressing aid of FIG. 7 with the arrows showing various orientations of the main arm and proximal and distal arms.

With reference to FIGS. 1-16 the present invention provides a dressing aid, designated by the numeral 10. In the drawings, not all reference numbers are included in each drawing for the sake of clarity. In addition, although other dimensions are possible, FIGS. 1-16 are CAD drawings, drawn to scale.

Referring to FIGS. 1-16, the present disclosure provides a dressing aid 10 that may include a main arm 12 having a proximal end 14 and a distal end 16. The dressing aid 10 may further include at least one (preferably at least two) proximal arm(s) 18 extending from the main arm proximal end 14, the proximal arm(s) 18 having a distal end 20 attached to the main arm proximal end 14 and a proximal end 22 attached to a proximal clip 24. The dressing aid 10 may further include at least one (preferably at least two) distal arm(s) 26 extending from the main arm distal end 16, the distal arm(s) 26 having a proximal end 28 attached to the main arm distal end 16 and a distal end 30 attached to a distal clip 32. Preferably, the main arm 12, the proximal arm(s) 18 and the distal arm(s) 26 are bendable/flexible by the user yet rigid in supporting the garment and not elastic. In other words, the main arm 12, the proximal arm(s) 18 and the distal arm(s) 26 are bendable by a user but retain their shape once bent and used by the individual to place a garment on himself/herself (until re-bent by the user). In some embodiments, the main arm 12, the proximal arm(s) 18 and/or the distal arm(s) 26 are formed of gooseneck tubing 90 or another type of bendable/flexible but rigid tubing. Gooseneck tubing 90, also known as stayput or obedient tubing, is known in the art and used in for example desk lamps and shower heads. An example of such tubing is the snakeclamp available at snakeclamp.com (Christianburg Va.). As explained at snakeclamp.com, the inside of the gooseneck may be a spring which is made of a high-strength steel (stainless steel can also be used if the gooseneck will be exposed to moisture). This is what gives the gooseneck its strength and flexibility. Then a soft galvanized iron wire is compressed into the gaps of the spring coil (stainless steel or brass can also be used). In addition to being made of a metallic material, gooseneck tubing may also be plastic. However, due to the increased strength, preferably the gooseneck tubing 90 is metallic. Gooseneck tubing 90 is only shown in FIG. 7 due to the complexity of drawing the spirals when the main arm 12, proximal arms 18, and distal arms 26 are bent. Though not shown, the gooseneck tubing 90 may be covered by foam as described with the embodiments below.

Figure 10:
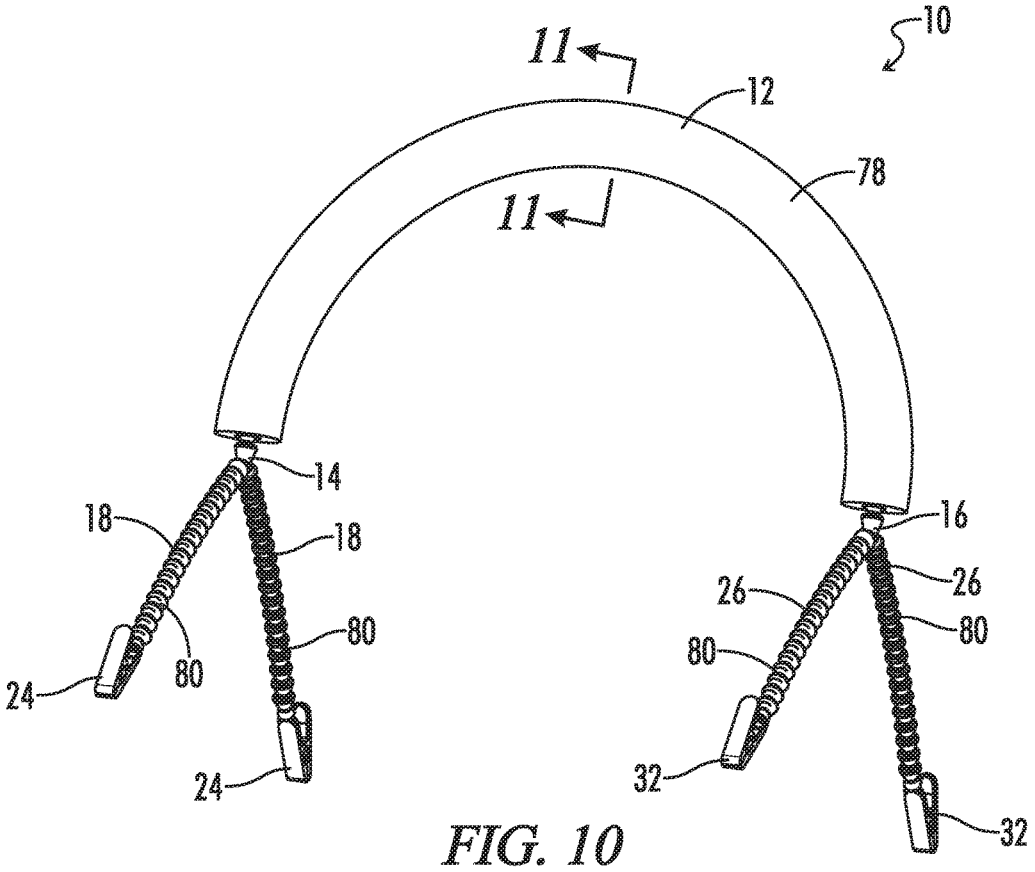
FIG. 10 illustrates a front perspective view of a dressing aid of another embodiment of the present invention.
Figure 11:
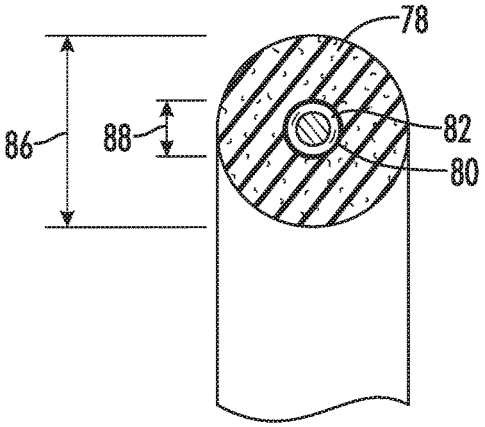
FIG. 11 illustrates a sectional view of the dressing aid of FIG. 10 taken along line 11-11 of FIG. 10.
Figure 12:
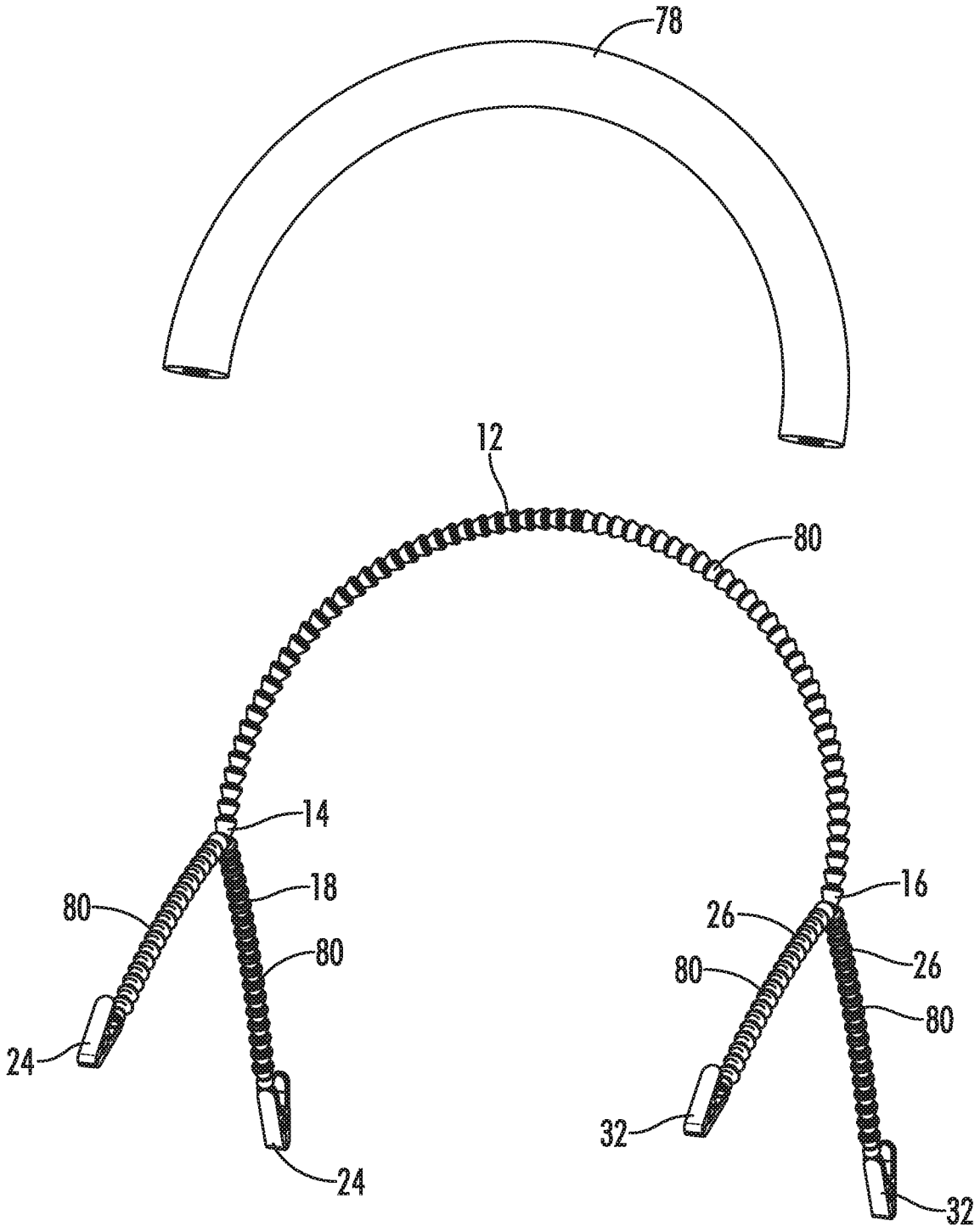
FIG. 12 illustrates a front perspective view of the dressing aid of FIG. 10 with the foam covering removed.
Figure 13:
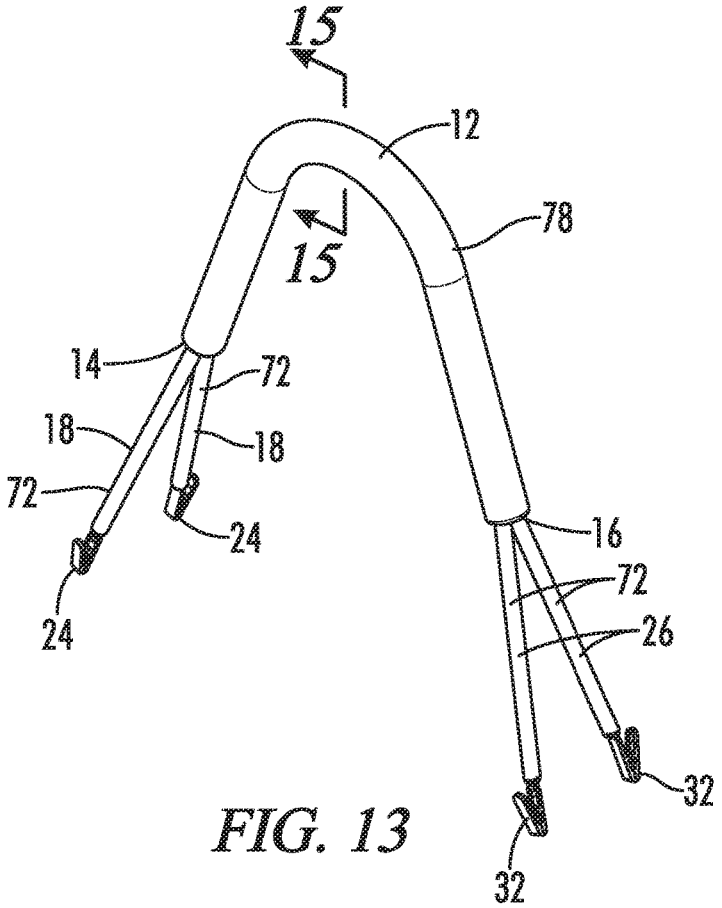
FIG. 13 illustrates a front perspective view of a dressing aid of another embodiment of the present invention.
Figure 14:
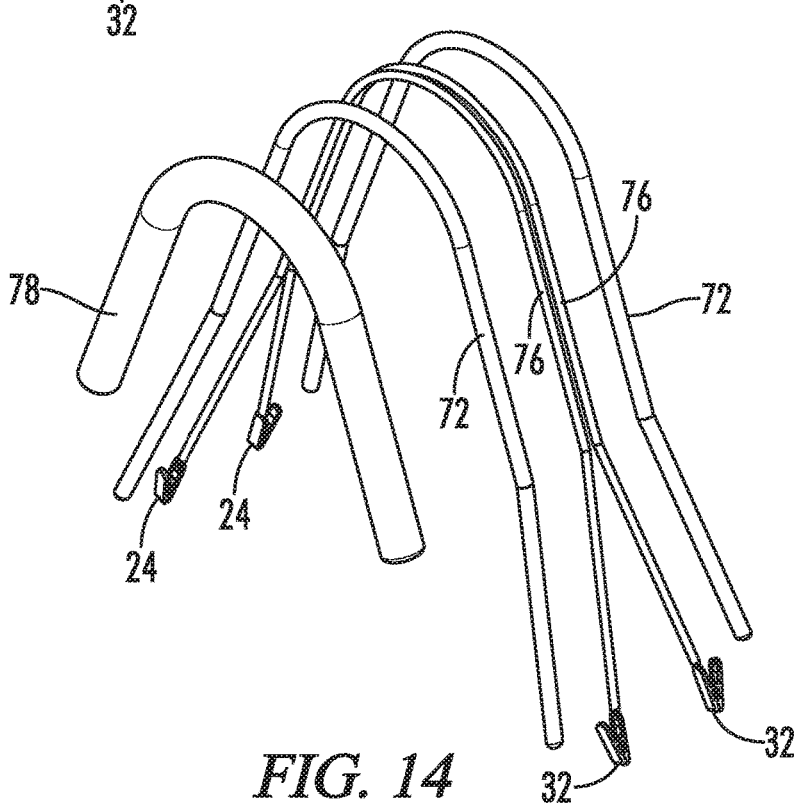
FIG. 14 illustrates a front perspective view of the dressing aid of FIG. 13 with the foam covering removed.
Figure 15:
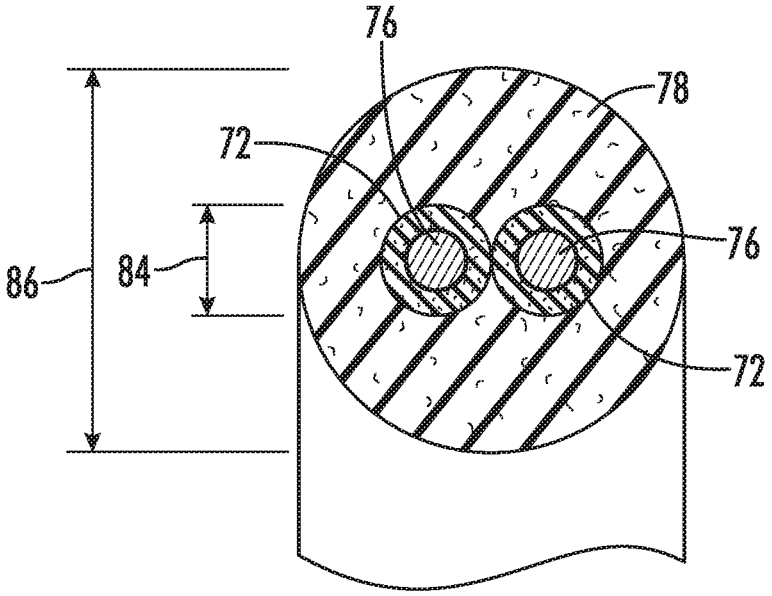
FIG. 15 illustrates a sectional view of the dressing aid of FIG. 13 taken along line 15-15 of FIG. 13.

In another embodiment, the main arm 12, the proximal arm(s) 18 and/or the distal arm(s) 26 are formed of flexible shaft(s) that may be partially or fully covered with a foam covering 78 (e.g., a closed cell foam that is about 1 inch in diameter). In the embodiment of FIGS. 13-15, the flexible shaft(s) is in the form of at least one flexible plastic tube 72 with a hollow interior that receives a metallic rod 76 (e.g., aluminum rod) and the flexible plastic tube 72 has a smaller outer diameter 84 than the outer diameter 86 of the foam covering 78, as best seen in the sectional view of FIG. 15. The metallic rod 76 may have an outer diameter of, for example, between about 0.125 inches and about 0.25 inches. However, it will be understood that such dimensions are exemplary. In such an embodiment, the combination of the flexible plastic tube 72 and metallic rod 76 (like gooseneck tubing) provide a product that is bendable by a user but retains its shape once bent and used by the individual to place a garment on himself/herself (until re-bent by the user). An example of a product with such a configuration is the Sammons Preston Flexible Teaspoon with Foam Handle by Performance Health (Warrenville, Ill.). In the embodiments, of FIGS. 13-15, the foam covering 78 covers the main arm 12 but not the proximal and distal arms 18 and 26. In the embodiment of FIGS. 13-15, the main arm 12 consists of two foam-covered plastic tubes 72 that are joined together, and the two tubes 72 disconnect at the main arm proximal and distal ends 14 and 16 and extend away from each other into two proximal and distal arms 18 and 26, as best seen in FIG. 14 and FIG. 15. In another embodiment, as shown in FIGS. 10-12, the shaft(s) is in the form of segmented ball and socket tubing 80, which (like gooseneck tubing 90) is bendable by a user but retains its shape once bent and used by the individual to place a garment on himself/herself (until re-bent by the user). Segmented ball and socket tubing 80 is known in the art and is sold under the tradename, LOC-LINE by Lockwood Products, Inc. of Oswego Oreg., for example. Preferably, the segmented ball and socket tubing 80 has a hollow interior 82. In some embodiments, the segmented ball and socket tubing is generally conical in shape (preferably truncated cones as shown in FIGS. 10-12). In a preferred embodiment, the ball and socket tubing 80 is plastic. In the illustrated embodiment of FIGS. 10-12, the foam covering 78 covers the main arm 12 but not the proximal and distal arms 18 and 26. Foam covering 78 is particularly useful with LOC-LINE products having a relatively high shore hardness. The foam covering outer diameter 86 is preferably greater than the segmented ball and socket tubing outer diameter 88.

As used herein, the word "attached" includes discretely joined separate parts as well as integral parts.

Instead of two proximal arms 18 and two distal arms 26, as shown in the drawings, the dressing aid 10 may simply comprise a main arm 12 having a proximal end 14 connected to a proximal clip 24 and a distal end 16 connected to a distal clip 32. However, at least two proximal arms 18 and at least two distal arms 26 connected to a main arm 12 is preferred.

Figure 9:
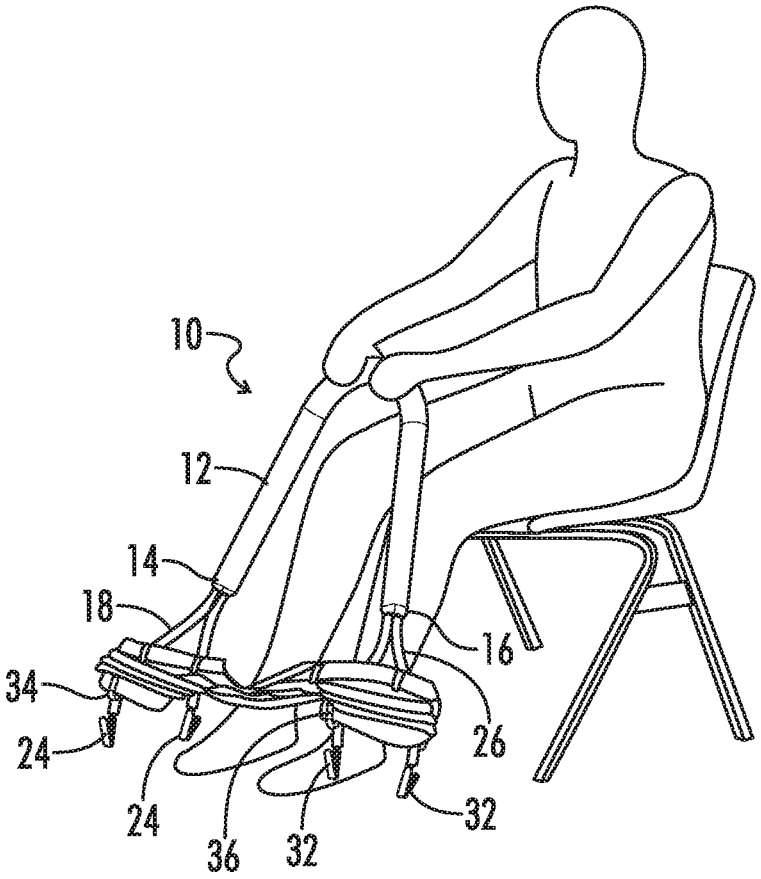
FIG. 9 illustrates a front perspective view of a person using the dressing aid of FIG. 8.

Optionally, each proximal arm 18 and each distal arm 26 comprises a hook 34,36, as illustrated in FIGS. 1-9 and 16. Optionally, each hook 34 of the proximal arm 18 comprises a lower end 38 attached to the proximal arm 18 and a free upper end 40 (that preferably points upwards) and each hook 36 of the distal arm 26 comprises a lower end 42 attached to the distal arm 26 and a free upper end 44 (that preferably points upwards). Optionally, the hooks 34,36 are L-shaped. Optionally, though the proximal arms 18 and distal arms 26 are preferably not elastic, the hooks 34,36 attached to the proximal arms 18 and distal arms 26 may be comprised of an elastic material. Optionally, each proximal arm 18 comprises a proximal arm interior surface 46 facing the other respective proximal arm 18 and a proximal arm exterior surface 48 opposite the interior surface 46, each distal arm 26 comprises a distal arm interior surface 50 facing the other respective distal arm 26 and a distal arm exterior surface 52 opposite the interior surface 50 and the hooks 34 of the proximal arms 18 are attached to the exterior surface 48 of the proximal arms 18 and the hooks 36 of the distal arms 26 are attached to the exterior surface 52 of the distal arms 26. The hook(s) 34,36, for example, may allow the user to secure the bottom of the pants 68 to the hook(s) 34,36 as best seen in FIG. 9, thus enabling the user to thread bilateral lower extremities through the waist opening rather than through the length of each pant 68 leg.

Optionally, the main arm 12 is in the shape of a bent cylinder comprising a main arm outer diameter 54. Optionally, the proximal arms 18 and the distal arms 26 are also in the shape of a bent cylinder, and the proximal arms 18 and distal arms 26 have a smaller outer diameter 56,58 as compared to the main arm outer diameter 54. Optionally, the clips 24 and 32 are alligator clips.

Optionally, the proximal arms 18 and the distal arms 26 are approximately the same length and shorter than the main arm 12. For example, the main arm 12 may be for example 45 inches in length and the proximal and distal arms 18,26 may each be 12 inches in length. However, it will be understood that such lengths are exemplary. Optionally, the dressing aid 10 is symmetrical with the proximal arm 18 and distal arm 26 approximately equidistant from the center 66 of the main arm length 64.

Figure 16:
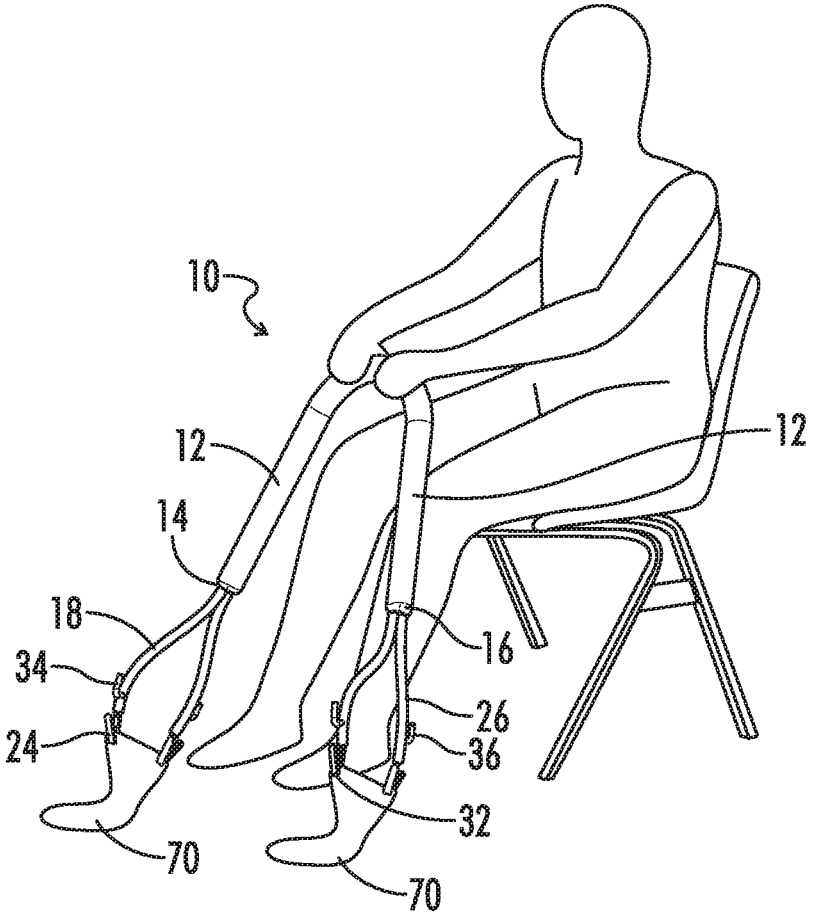
FIG. 16 illustrates a front perspective view of a person using a dressing aid of one embodiment of the present invention.

The dressing aid 10 may be used in a method that includes a) providing the dressing aid 10; b) providing a garment; c) attaching the clips 24,32 to the garment; and d) grasping the main arm 12 and moving the garment over a user. For example, if the garment is a leg garment, such as a pair of pants 68, the user may position the garment at the user's feet and may pull the leg garment upwardly, as shown in FIGS. 1, 9 and 16. Optionally, each proximal arm 18 and distal arm 26 is bent in multiple directions, as best seen in FIGS. 1, 3, 5, and 6. Optionally, the main arm 12 is U-shaped as best seen in FIGS. 1-4, 8, 9, 10 and 13. Optionally, the method further comprises draping the garment over the hooks 34,36, as best seen in FIG. 9. In addition to a pair of pants, the dressing aid 10 may be used with other garments such as socks 70 or shirts. For example, FIG. 16 shows a user using the dressing aid 10 to put on a pair of socks 70.

| Part List | |
|---|---|
| Dressing aid | 10 |
| Main arm | 12 |
| Main arm proximal end | 14 |
| Main arm distal end | 16 |
| Proximal arms | 18 |
| Proximal arm distal end | 20 |
| Proximal arm proximal end | 22 |
| Proximal clip | 24 |
| Distal arms | 26 |
| Distal arm proximal end | 28 |
| Distal arm distal end | 30 |
| Distal clip | 32 |
| Proximal hook | 34 |
| Distal hook | 36 |
| Proximal hook lower end | 38 |
| Proximal hook upper end | 40 |
| Distal hook lower end | 42 |
| Distal hook upper end | 44 |
| Proximal arm interior surface | 46 |
| Proximal arm exterior surface | 48 |
| Distal arm interior surface | 50 |
| Distal arm exterior surface | 52 |
| Main arm outer diameter | 54 |
| Proximal arm outer diameters | 56 |
| Distal arm outer diameters | 58 |
| Proximal arm length | 60 |
| Distal arm length | 62 |
| Main arm length | 64 |
| Main arm center | 66 |
| Pants | 68 |
| Socks | 70 |
| Plastic Tube | 72 |
| Bendable Metallic Rod | 76 |
| Foam Covering | 78 |
| Ball and Socket Tubing | 80 |
| Ball and Socket Tubing Interior | 82 |
| Plastic Tube Outer Diameter | 84 |
| Foam Covering Outer Diameter | 86 |
| Ball and Socket Tubing Outer Diameter | 88 |
| Gooseneck Tubing | 90 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously. It is understood that use of the singular embraces the plural and vice versa.

What is claimed is:

1. A method of donning a lower extremity garment comprising the steps of:

a) providing a dressing aid comprising:

i) a main arm having a proximal end and a distal end;

ii) at least two proximal arms extending from the main arm proximal end, each of the at least two proximal arms having a distal end attached to the main arm proximal end and a proximal end attached to a proximal clip;

iii) at least two distal arms extending from the main arm distal end, each of the at least two distal arms having a proximal end attached to the main arm distal end and a distal end attached to a distal clip, wherein the main arm, the at least two proximal arms and the at least two distal arms are bendable, rigid and not elastic;

b) providing a lower extremity garment;

c) attaching the proximal clips to the lower extremity garment; and d) grasping the main arm, positioning the lower extremity garment at a foot of a user and moving the lower extremity over the foot of the user.

2. The method of claim 1 wherein the at least two proximal arms and the at least two distal arms are comprised of at least one tube having a hollow interior comprising a bendable metallic rod.

3. The method of claim 2 wherein the at least one tube is plastic.

4. The method of claim 3 further comprising a foam covering surrounding at least a portion of the main arm.

5. The method of claim 4 wherein the foam covering does not cover the at least two proximal arms and the at least two distal arms.

6. The method of claim 4 wherein the foam covering is comprised of a closed cell foam.

7. The method of claim 4 wherein the foam covering and the main arm are generally U-shaped.

8. The method of claim 2 wherein the at least one tube is comprised of two tubes that are joined to form the main arm, the two tubes extending away from each other at the proximal and distal ends of the main arm to form two proximal and two distal arms.

9. The method of claim 1 wherein the at least two proximal arms and the at least two distal arms are comprised of segmented ball and socket tubing having a hollow interior.

10. The method of claim 9 further comprising a foam covering surrounding at least a portion of the main arm.

11. The method of claim 10 wherein the foam covering does not cover the at least two proximal arms and the at least two distal arms.

12. The method of claim 10 wherein the foam covering is comprised of a closed cell foam.

13. The method of claim 10 wherein the foam covering and the main arm are generally U-shaped.

14. The method of claim 1 wherein at least one proximal arm and at least one distal arm comprises a hook.

15. The method of claim 14 wherein each hook of the proximal arm comprises a lower end attached to a proximal arm and a free upper end and further wherein each hook of the distal arm comprises a lower end attached to a distal arm and a free upper end and further wherein the hooks are L-shaped.

16. The method of claim 1 wherein the main arm is in the shape of a bent cylinder, wherein the proximal arms and the distal arms are in the shape of bent cylinders, wherein the main arm comprises an outer diameter, and further wherein the proximal arm and distal arms each have a smaller outer diameter as compared to the main arm outer diameter.

17. The method of claim 1 wherein the proximal arms and the distal arms are approximately the same length and shorter than the main arm.

18. The method of claim 1 wherein the lower extremity garment comprises an opening and step d) comprises grasping the main arm, positioning the opening of the lower extremity garment at a foot of a user and moving the lower extremity garment over the foot of the user.

19. The method of claim 18 wherein step c) comprises attaching the proximal clips on opposite sides of the opening of the lower extremity garment.

20. The method of claim 1 wherein step c) comprises attaching the proximal clips and the distal clips to the lower extremity garment.

21. A dressing aid comprising:

a main arm having a proximal end and a distal end;

at least two proximal arms extending from the main arm proximal end, each of the at least two proximal arms having a distal end attached to the main arm proximal end and a proximal end attached to a proximal clip;

at least two distal arms extending from the main arm distal end, each of the at least two distal arms having a proximal end attached to the main arm distal end and a distal end attached to a distal clip, wherein the at least two proximal arms and the at least two distal arms are comprised of at least one plastic tube having a hollow interior comprising a bendable metallic rod.

22. The dressing aid of claim 21 wherein the main arm, the at least two proximal arms and the at least two distal arms are bendable, rigid and not elastic.

23. A dressing aid comprising:

a main arm having a proximal end and a distal end;

at least two proximal arms extending from the main arm proximal end, each of the at least two proximal arms having a distal end attached to the main arm proximal end and a proximal end attached to a proximal clip;

at least two distal arms extending from the main arm distal end, each of the at least two distal arms having a proximal end attached to the main arm distal end and a distal end attached to a distal clip, wherein the at least two proximal arms and the at least two distal arms are comprised of at least one tube having a hollow interior comprising a bendable metallic rod, and further wherein the at least one tube is comprised of two tubes that are joined to form the main arm, the two tubes extending away from each other at the proximal and distal ends of the main arm to form two proximal and two distal arms.

24. The dressing aid of claim 23 wherein the main arm, the at least two proximal arms and the at least two distal arms are bendable, rigid and not elastic.

25. A dressing aid comprising:

a main arm having a proximal end and a distal end;

at least two proximal arms extending from the main arm proximal end, each of the at least two proximal arms having a distal end attached to the main arm proximal end and a proximal end attached to a proximal clip;

at least two distal arms extending from the main arm distal end, each of the at least two distal arms having a proximal end attached to the main arm distal end and a distal end attached to a distal clip, wherein the at least two proximal arms and the at least two distal arms are comprised of segmented ball and socket tubing having a hollow interior.

26. The dressing aid of claim 25 wherein the main arm, the at least two proximal arms and the at least two distal arms are bendable, rigid and not elastic.

27. A dressing aid comprising:

a main arm having a proximal end and a distal end;

at least two proximal arms extending from the main arm proximal end, each of the at least two proximal arms having a distal end attached to the main arm proximal end and a proximal end attached to a proximal clip;

at least two distal arms extending from the main arm distal end, each of the at least two distal arms having a proximal end attached to the main arm distal end and a distal end attached to a distal clip, wherein the main arm is in the shape of a bent cylinder, wherein the proximal arms and the distal arms are in the shape of bent cylinders, wherein the main arm comprises an outer diameter, and further wherein the proximal arm and distal arms each have a smaller outer diameter as compared to the main arm outer diameter.

28. The dressing aid of claim 27 wherein the main arm, the at least two proximal arms and the at least two distal arms are bendable, rigid and not elastic.

* * * * *